United States Patent [19]

Cochran et al.

[11] Patent Number: 4,593,638

[45] Date of Patent: Jun. 10, 1986

[54] ARRANGEMENT AND METHOD FOR ACHIEVING AN AERODYNAMIC MAST PROFILE FOR SAILCRAFT

[76] Inventors: Steven M. Cochran, 4916 Mansfield, Royal Oak, Mich. 48083; Mark J. Murphy, 1228 Oakwood Ct., Rochester, Mich. 48063

[21] Appl. No.: 687,993

[22] Filed: Dec. 31, 1984

[51] Int. Cl.[4] ..... B63H 9/08

[52] U.S. Cl. ..... 114/39; 114/90; 114/103

[58] Field of Search ..... 114/39, 39.2, 102, 103, 114/90, 243

[56] References Cited

U.S. PATENT DOCUMENTS

| | | | |
|---|---|---|---|
| Re. 31,167 | 3/1983 | Schweitzer et al. | 114/39.2 |
| 3,132,620 | 5/1964 | Court | 114/102 |
| 3,391,668 | 7/1968 | Birchill | 114/103 |
| 3,802,366 | 4/1974 | Mankawich | 114/39 |
| 4,344,377 | 8/1982 | Gram | 114/103 |
| 4,369,724 | 1/1983 | Weiss | 114/39 |
| 4,386,574 | 6/1983 | Riolland | 114/103 |
| 4,388,888 | 6/1983 | Gushurst, Jr. | 114/90 |

FOREIGN PATENT DOCUMENTS

| | | | |
|---|---|---|---|
| 3211641 | 10/1983 | Fed. Rep. of Germany | 114/103 |
| 2803957 | 5/1984 | Fed. Rep. of Germany . | |
| 48304 | 4/1983 | Japan | 114/103 |

*Primary Examiner*—Sherman D. Basinger
*Assistant Examiner*—Paul E. Salmon
*Attorney, Agent, or Firm*—John R. Benefiel

[57] ABSTRACT

An arrangement is disclosed which secures the sail to the mast of a sailing craft to achieve an aerodynamic profile about the mast while allowing curvature in the mast for optimum sail profile. The arrangement includes an outer profile sleeve of flexible material extending from a line of securement to the rear of the luff of the sail forwardly around the mast. The profile sleeve receives one or more semi-rigid, flexible profile members comprised of lightweight plastic sections configured to be tightly fit therein, stretching the profile sleeve into a high efficiency wing shape surrounding the mast. The wing shape includes a leading parabolic surface and curved sides smoothly transitioning into the main sail area to create a lift airfoil with the sail angled either to port or starboard.

16 Claims, 7 Drawing Figures

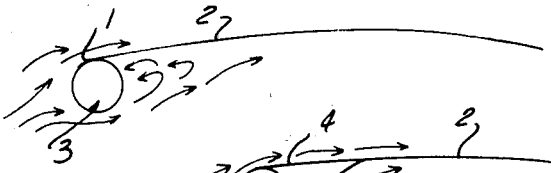
FIG-1A
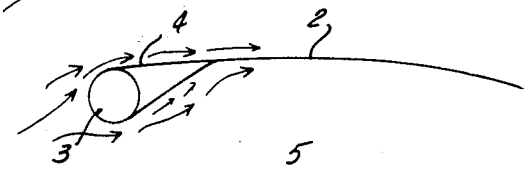
FIG-1B
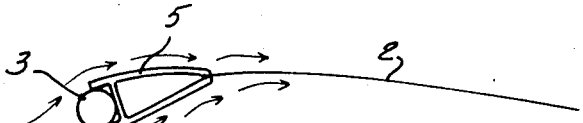
FIG-1C
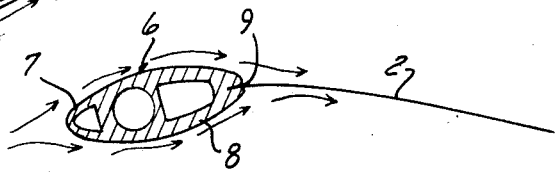
FIG-1D
FIG-2
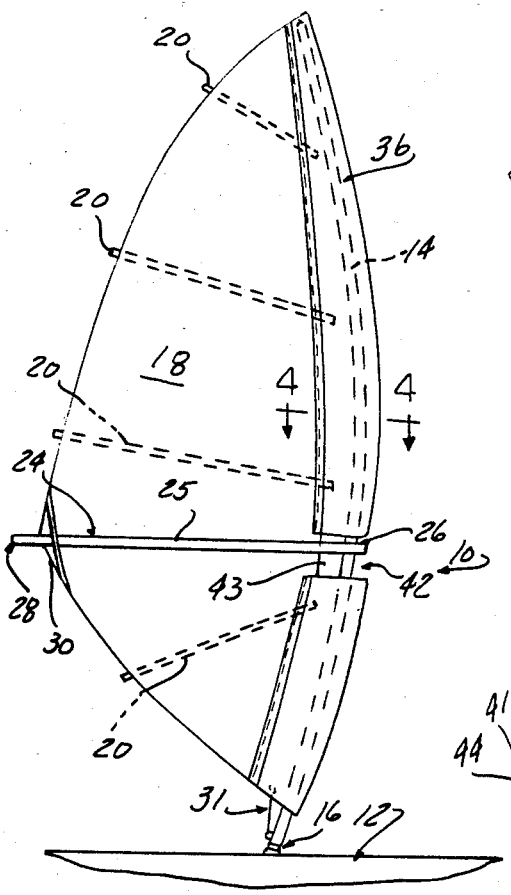
FIG-3
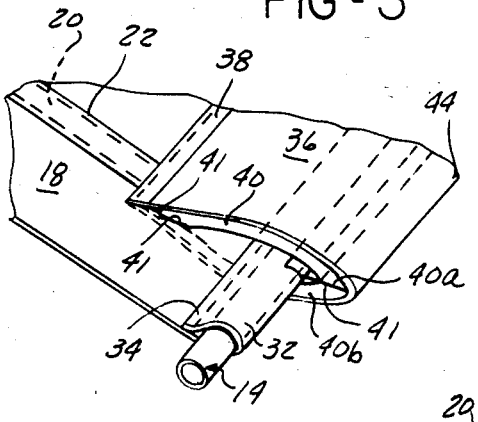
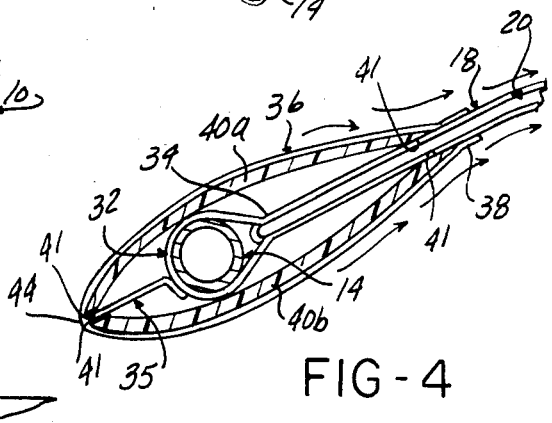
FIG-4

ARRANGEMENT AND METHOD FOR ACHIEVING AN AERODYNAMIC MAST PROFILE FOR SAILCRAFT

BACKGROUND DISCUSSION

This invention concerns arrangements and methods for achieving a high aerodynamic efficiency of the mast and adjacent sail areas and more particularly concerns such arrangements and methods having particular application to lightweight sailing craft such as windsurfing sailing boards. The present invention also concerns arrangements compatible with the manual exertions required in maneuvering such craft, specifically the need for easy righting of the sail and mast from a capsized condition.

Windsurfing sailing boards consist of a simple board hull on which is pivotally attached a lightweight flexible mast and a boom attached intermediate the height of the mast surrounding the sail and secured along one side thereof to the mast. The sail is attached to the boom and mast so as to be drawn into a curved shape for optimal sail shape in profile, i.e., to minimize induced drag by creating a roughly elliptical sail profile.

The sailor stands atop the board hull and grasps the boom to execute sailing maneuvers by shifting of body weight and the sail angle in the manner well known to those skilled in the art.

The sail is relatively small in area and the craft is lightweight, such that aerodynamic efficiency of the mast and adjacent sail areas has a pronounced effect on craft performance. That is, the lift achieved by airflow past the mast and adjacent sail areas significantly affects performance.

Swamping of the craft is an oftentimes occurrence, such that ease in righting the mast and sail assembly are of great importance in the design of such craft.

Such craft are usually sold for relatively low prices, such that a simple, inexpensive construction is a necessary design criteria.

Common prior art arrangements for securing the sail to the mast are shown in FIGS. 1*a*–1*d*. In the first of these shown in FIG. 1*a*, a sleeve 1 is formed along the luff of the sail 2, sized such that it is to be tightly fit to the mast 3 which is received within the sleeve 1. Oftentimes, full-length battens are provided, received in pockets formed in the sail and, in the tight sleeve design, the orientation of the sleeve is such as to allow smooth transitioning of battens into the mast sleeve perimeter as shown.

While simple, this design exhibits poor aerodynamic efficiency due to the "dead zone" to the rear of the mast adjacent to the trailing sail surface.

In an attempt to improve the aerodynamic efficiency, so-called bag sleeves have been developed, shown in FIG. 1*b*, in which the bag sleeve 4 extends several inches to the rear of the mast 3. This design is effective in substantially improving the aerodynamic efficiency, although some turbulence still results, as indicated. For board sailing applications, the bag sleeve 4 has a tendency to trap water upon upsetting of the sail, making the righting maneuver more difficult.

Further improvements in aerodynamic efficiency have been produced by so-called "camber influencers", shown in FIG. 1*c*, which are wishbone-shaped plastic devices 5 shaped like a capital letter "A", with the legs of the "A" fit against the mast end and the peak of the "A" being slotted to receive the battens. These devices have been effective in substantially improving the aerodynamic efficiency of the bag sleeve 4, while providing a more rigid definition of the transition from the mast 3 to the main sail area 2.

The most highly efficient aerodynamic shape has been the so-called "wing mast", shown in FIG. 1*d*, in which the mast itself is shaped as an air foil 6 with a leading parabolic surface area 7 forward of the mast and trailing smoothcurved sides 8 converging to the rear of the mast. A central slot 9 is provided for securement of the sail 2 to the mast. While providing optimum aerodynamic efficiency, the wing mast incurs a substantial cost and weight penalty resulting from the increased structural requirements of the wing section. Importantly, the mast profile is incompatible with a full length flexible mast to allow full length curvature thereof, such that an optimal profile is only achievable by add-on fairing members.

Prior art efforts have also included the use of shaped rigid members fit over the mast and adjacent sail areas, but this approach also increases the mass and complexity of the craft and is incompatible with full length curving of a flexible mast.

It is also important that any such arrangement and method would be compatible with other standard rigging components to render application of the arrangement simpler and lower in cost.

Accordingly, it is an object of the present invention to provide an arrangement for achieving a highly efficient aerodynamic shape of the mast and adjacent sail areas.

It is another object of the present invention to provide such an arrangement which is compatible with flexible mast curved luff profile constructions, and which is compatible with standard rigging components.

It is yet another object of the present invention to provide such an arrangement which is simple, low in cost and lightweight.

It is still another object of the present invention to provide such an arrangement which allows for easy righting of the mast from a capsized condition.

SUMMARY OF THE INVENTION

These and other objects of the present invention, which will become apparent upon a reading of the following specification and claims, are achieved by an arrangement comprised of an outer or profile sleeve of flexible sail material extending along the luff of the sail and extending forwardly of the mast, from a line of securement spaced to the rear of the luff, such as to enclose the mast and adjacent sail areas.

One or more profile members are provided which are of semi-rigid construction able to be resiliently deformed, so as to be able to be tightly fit within the profile sleeve and within the space intermediate the mast.

The profile members are bent into a curved shaped and thereby also stretch the profile sleeve into an aerodynamic shape which may be of optimum proportions, including a parabolic leading surface and smoothly curving trailing side surfaces converging at the line of securement of the profile sleeve.

The mast may be mounted to the luff of the sail by an inner sleeve and is preferably located fore and aft within the profile sleeve by a tension web extending between the inner and outer sleeve at the leading side of each sleeve, which web is stretched taut by insertion of the profile members. The mast is thereby located within the rearward portion of the leading edge at a distance equal to one-third of the total length of the air foil for optimum performance.

The sail main area is received at the rear convergence of the sides of the aerodynamic shape.

The one or more profile members preferably are comprised of one or more pairs of opposed profile members being fit together about the mast and inner sleeve against the sail main section at the rear of the outer sleeve, and the web section at the front of the outer sleeve.

Full length sail battens may be received between the ends of the opposed profile members extending to a point adjacent the inner sleeve.

The profile members are preferably comprised of flat sections of a semi-rigid, lightweight material, such as polyethylene, which also preferably is of closed-cell construction to minimize the trapped water and allow easy righting of the mast and sail from the capsized condition and to provide floatation for the mast. This arrangement allows for low cost, lightweight construction, and yet affords optimum aerodynamic efficiency, including a curved mast construction, to thereby achieve the above-recited objects of the present invention.

DESCRIPTION OF THE DRAWINGS

FIGS. *1a–1d* are diagrammatic representatives of typical prior art mast and sail mounting arrangements in cross section, together with a depiction of air flow therearound.

FIG. 2 is a side elevational view of a board sailing craft depicting the board hull in fragmentary form and illustrating the mast sail mounting arrangement according to the present invention.

FIG. 3 is a perspective view of the section detail of the sail mast mounting arrangement according to the present invention.

FIG. 4 is a sectional view of the mast sail mounting arrangement according to the present invention depicting the high efficiency aerodynamic flow characteristics thereof.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIGS. 2–4, the arrangement according to the present invention can be understood.

The present invention is contemplated as having particular advantage applied to the sailboard sailing craft, which may be of otherwise conventional construction. In FIG. 2, the basic arrangement of such sailing craft is depicted, although the conventional details are not shown inasmuch as these are well understood by those skilled in this particular art.

Essentially, the sailing board 10 consists of a board hull 12 configured like a surfboard, and which carries a generally upstanding mast 14, connected to the board hull 12 by means of a pivotal joint 16 which allows the mast 14 to be pivoted during sailing maneuvers in a manner well known to those skilled in the art. The mast 14 is of a flexible construction to be able to be drawn into a curved shape by the mounting of the sail. For this purpose, the mast is constructed of lightweight semi-rigid material such as glass laminate or thin wall aluminum tubing.

The generally triangular sail 18 is mounted to the mast 14 along the luff as by being received in an inner sleeve 32, as will be described hereinafter in detail.

The sail 18 may include battens 20 received within sewn pockets 22 (FIG. 3) which as shown may be full length, i.e., extending from the leech and foot sides of the sail 18 inwardly to a point adjacent the mast 14. Control of the sail and mast assembly is achieved by means of a wishbone-shaped boom 24 of conventional construction, including a pair of arms 25 extending on either side of the mast 14 converging on the mast 14 at a point intermediate its height, with a joint connection 26 attaching the boom 24 thereto. The boom 24 also includes a joint 28 securing together the outboard ends of the arms 25.

The outhaul 30 attached to the boom 24 and sail 18 holds the sail 18 extended as shown in FIG. 2, while a down haul 31 attached to the sail 10 and mast 14 holds the sail 18 down against the closed upper end of the inner sleeve 32.

The arrangement for mounting the sail 18 to the mast 14 is best seen in FIG. 3 and includes an inner sleeve 32 attached to the sail 18, extending along the edge to be mounted to the mast 14. The inner sleeve 32 is sized to just slidably receive the mast 14 and may be formed by a sewn looped section of flexible material, sewn along a seam 34.

Since all of these major components are of conventional construction, details thereof are not here set forth inasmuch as they do not comprise of themselves the present invention.

The concept of the present invention concerns an arrangement and method for producing an optimum aerodynamic efficiency of the mast and adjacent sail areas, while using a flexible mast and conventional rigging.

This arrangement includes an outer profile sleeve 36, surrounding the inner sleeve 32, the profile sleeve being of flexible waterproof material, such as Dacron, which extends from a line of attachment consisting of seam 38 spaced inwardly from the luff and inner sleeve 32. The profile sleeve 36 also extends forwardly beyond the location of the inner sleeve 32, and a fore and aft locating tension web 35 is sewn in extending from the forward outside of the inner sleeve 32 to the forward inside portion of the profile sleeve 36.

Installed in the profile sleeve 36 are one or more profile members 40, which in the embodiment shown in the drawings, consist of opposed pairs **40*a* and 40*b* tightly fit within the profile sleeve 36 sandwiching therebetween the inner sleeve 32 and mast 14**.

The profile members 40 are slabs of relatively thick, lightweight, semi-rigid plastic, which uninstalled, assume a flat shape with angled sides 41. The semi-rigid characteristic allows ready resilient deflection to substantially occupy the inner periphery of the outer sleeve 36. The resilient nature of the profile members 40 causes stretching of the profile sleeve 36 into an aerodynamic shape and also causes drawing of the tension web 35 taut.

The angled sides 41 are pressed against the sail 18 at the rear and the tension web 35 at the front as shown.

Suitable characteristics have been found to be provided by sheets of closed-cell polyethylene plastic of a density approximately equal to five pounds per cubic foot, with a one-half inch thickness.

Such members may be manufactured at low cost, as will be appreciated by those skilled in the art.

The stretching of the profile sleeve 36 by the tension created by resilient bending of profile members 40 prevents any gathering of the material. Also, the material of the profile sleeve 36 is impermeable, eliminating entrapment of water upon capsizing of the mast and sail, to thereby allow easy righting maneuvers.

The opposed pairs of profile members 40*a* and 40*b* are installed within the outer sleeve 36, in the upper region of the mast 14 and the lower region of the mast 14, leaving a space 42 therebetween to accommodate the boom 24. A curved fairing 43 may be inserted in space 42 to minimize the effects of the presence of the gap 44.

Full-length battens 20 may be received between the trailing sides 41 of the profile members 40*a* and 40*b* to be able to extend therebetween, to a point adjacent the inner sleeve 32 as seen in FIG. 4.

According to FIG. 4, it can be seen that the aerodynamic shape created includes a parabolic leading surface 44 which extends abaft from a point forward of the mast 14 and curved sides affording a smooth transition by converging into the main area of the sail 18, such that an optimum "wing" profile is provided.

This arrangement allows curving of the mast 14 and also produces a lifting airfoil shape with the sail 18 angled either to port or starboard.

It is also preferred that the configuration of the profile members 40 and the width of the web 35 is selected to locate the mast 14 at a point equal to one-third of the distance measured from the leading surface 44. Such a location affords an optimum aerodynamic efficiency.

The mast-sail profile is considerably thickened by this arrangement to provide optimum lift characteristics at the relatively low wind speeds encountered during wind surfing maneuvers. This is achieved, according to the present invention, without incurring the considerable cost and weight penalties of the full wing-shaped mast profile.

In mounting of the sail 18, the mast 14 is inserted into the inner sleeve 32 and positioned as shown in FIG. 2.

Subsequently, the one or more profile members are installed by being inserted into the outer sleeve 36 to produce a relatively tight, stretched condition of the outer sleeve 36 and web 35, sandwiching the mast 14 and inner sleeve 34 therein, both above and below the boom 24.

The mast 14 is located at the proper distance by the tension web behind the leading parabolic surface of the profile by the stretched tension web 35 inner sleeve 32, and line of attachment 38.

Accordingly, a relatively simple, low cost construction affords all the advantages of the wing mast without the cost and weight penalties associated with that form of construction, and is compatible with curved mast constructions and also with other conventional rigging components. Also, this arrangement produces a cushioning of the mast 14, such that protection against the jarring impacts with the mast 14 is afforded by the foamed plastic profile members 40.

It can be appreciated that many variations of the details disclosed herein are possible, such as alternate configurations of the semi-rigid formulations or non-plastic materials, and application to sailing craft other than sailboards, without departing from the spirit of the present invention as set forth in the appended claims.

What is claimed is:

1. An arrangement for achieving an aerodynamic shape for a mast and adjacent main sail areas of a sailing craft, comprising:

an outer profile sleeve of flexible material secured along the luff of said sail, extending from a line of attachment spaced inwardly from the luff of the sail and extending forwardly of and around the mast;

one or more pairs of profile members tightly fit into said profile sleeve while allowing clearance of said mast therebetween, said one or more profile members and said profile sleeve assembled together onto said mast with said profile members extending on either side of said mast and forming an aerodynamic shape, extending around and along the length of said mast, transitioning into the main area of said sail;

said one or more pairs of profile members each formed of a pair of flat sections of semi-rigid, resilient material each bent into a curved shape with a space therebetween by the constraint of said profile sleeve and passage of said mast therebetween separating said profile members and stretching said profile sleeve into said aerodynamic shape.

2. The arrangement according to claim 1 wherein said aerodynamic shape formed by said one or more profile members and said profile sleeve comprises a leading surface parabolic in section, extending to side surfaces curving smoothly to converge at said line of securement to said sail main area.

3. The arrangement according to claim 1 including means locating said mast rearwardly one-third of the total distance from the leading edge to the line of attachment.

4. The arrangement according to claim 1 further including a plurality of batten pockets formed in said sail, and a plurality of battens received in said pockets and wherein said battens extend freely into said outer sleeve into said space between said opposed profile members.

5. The arrangement according to claim 1 wherein said profile members are formed of closed-cell foamed plastic approximately one-half inch in thickness.

6. The arrangement according to claim 1 wherein said mast is secured to the luff of said sail by a portion of the luff of said sail extending into said outer sleeve, and an inner sleeve attached to the luff of said sail, and inner sleeve adapted to be fit over said mast, and also including means for locating said mast fore and aft within said outer sleeve comprising a tension web extending between said inner and profile sleeves and drawn taut by said one or more pairs of profile members.

7. An improved board sail craft of the type including a board hull, a flexible mast pivotally connected to said board hull, a roughly triangular sail mounted to said mast along the luff thereof, said sail mounted thereto by an improved arrangement, comprising:

an inner sleeve secured to said sail extending along the luff of said sail to be secured to said mast and sized to be just slidably fit thereover;

an outer profile sleeve of flexible material secured to said sail and passing around said inner sleeve, extending from a line of attachment spaced rearwardly from said inner sleeve and extending forwardly thereover;

one or more profile members configured to be tightly fit into the space between said inner sleeve and said profile sleeve while allowing clearance of said mast therethrough, said one or more profile members, said mast, and said profile sleeve assembled together with said profile member extending respectively along either side of said mast to stretch said outer sleeve to form an aerodynamic profile along the length of said mast transitioning into the main area of said sail;

a tension element connected between the forward side of said inner sleeve and said inside of the forward side of said profile sleeve whereby said mast is located fore and aft within said profile sleeve.

8. The arrangement according to claim 7 wherein said one or more profile members are formed of one or more opposed pairs of flat sections of flexible, semi-rigid foam plastic.

9. The arrangement according to claim 7 wherein said aerodynamic shape formed by said one or more profile members and said profile sleeve comprises a leading surface parabolic in section extending to said side surfaces, curving smoothly to converge at said line of securement to said sail main area.

10. The arrangement according to claim 9 wherein said mast is located rearwardly one-third of the total distance from said leading edge to said line of attachment.

11. The arrangement according to claim 7 wherein one or more opposed pairs of profile members are fit within said profile sleeve, sandwiching said inner sleeve and mast therebetween.

12. The arrangement according to claim 11 wherein said sail includes a plurality of battens disposed in pockets formed in said sail, and wherein said battens extend freely between said opposed profile members to a point adjacent said inner sleeve.

13. The arrangement according to claim 12 wherein said profile members are formed of closed-cell foamed plastic slabs approximately one-half inch in thickness.

14. The arrangement according to claim 7 wherein said sailboard includes a boom attached to said mast intermediate the height of said mast and wherein opposed pairs of profile members are disposed above and below said boom within said outer sleeve.

15. A method of attaching a sail to a mast comprising:

forming an inner sleeve along the side of the sail to be attached, sized to slidably receive said mast therein;

forming an outer sleeve of flexible material extending along said sail side and including the step of attaching said material along a first line of attachment on one side of said sail spaced inwardly from said inner sleeve and extending said material outwardly beyond said inner sleeve and looping said material back to a second line of attachment on the opposite side of said sail also spaced inwardly from said inner sleeve;

forming one or more profile members adapted to be resiliently deformed to be tightly fit within said outer sleeve while allowing clearance for said mast received within said inner sleeve, said one or more profile members forming an aerodynamic shape when assembled in said profile sleeve with said profile sleeve fit over said mast;

assembling said one or more profile members into said outer sleeve to stretch said outer sleeve into an aerodynamic shape extending forwardly and rearwardly of said mast;

fixing a fore and aft extending tension web between said inner and outer sleeves so as to be stretched taut upon assembly of said profile members into said outer sleeve to locate said mast at a predetermined fore and aft location within said outer sleeve.

16. The method according to claim 15, wherein opposed pairs of said profile members are installed above and below a boom attached to said mast at a point intermediate its height.

* * * * *